US005971861A

United States Patent [19]

Wright

[11] Patent Number: 5,971,861

[45] Date of Patent: Oct. 26, 1999

[54] GAMING TABLE CONVERSION FOR POOL TABLES

[76] Inventor: Jonathan C. Wright, 14 Aberdeen Ct., Fort Smith, Ark. 72908-9001

[21] Appl. No.: 09/005,828

[22] Filed: Jan. 12, 1998

[51] Int. Cl.[6] ..... A47C 17/62

[52] U.S. Cl. ..... 473/14; 473/10; 473/4

[58] Field of Search ..... 473/4, 14, 3, 5, 473/6, 7, 8, 10

[56] References Cited

U.S. PATENT DOCUMENTS

| | | | |
|---|---|---|---|
| 278,314 | 5/1883 | Eelly | 473/3 |
| 484,432 | 10/1892 | Hyde | 473/14 |
| 512,337 | 1/1894 | Standen | 473/10 |
| 572,688 | 12/1896 | Seifert . | |
| 736,928 | 8/1903 | Clark | 473/14 |
| 1,725,069 | 8/1929 | Eyles | 473/14 |
| 3,001,843 | 9/1961 | Davis . | |
| 3,088,740 | 5/1963 | Ericksen | 473/14 |
| 3,237,941 | 3/1966 | Vincent | 473/4 |
| 4,065,125 | 12/1977 | Chan . | |
| 4,160,550 | 7/1979 | Barrett | 473/3 |
| 4,474,374 | 10/1984 | Lewis et al. . | |

*Primary Examiner*—Sam Rimell
*Attorney, Agent, or Firm*—Joseph H. McGlynn

[57] ABSTRACT

A kit for converting a pool table to a surface that other games, such as "craps" can be played on. The kit contains a game playing surface that can be placed on top of the pool table surface and a vertical boundary layer that can be secured around the periphery of the game playing surface in order to cover the pockets in the pool table so that items will not fall into the pockets on the pool table.

6 Claims, 1 Drawing Sheet

GAMING TABLE CONVERSION FOR POOL TABLES

BACKGROUND OF THE INVENTION

This invention relates, in general, to gaming tables, and, in particular, to a system for converting a gaming table from one type of game to another.

DESCRIPTION OF THE PRIOR ART

In the prior art various types of conversions for gaming tables have been proposed. For example, U.S. Pat. No. 572,688 to Seifert discloses a table which has a drawer in which other game tops may be stored and placed on top of the table to change from one game to another.

U.S. Pat. No. 3,001,843 to Davis discloses a convertible table with a removable top which can be removed to convert the table to a card table.

U.S. Pat. No. 4,065,125 to Chan discloses a pool table which has a checker board marked on its upper surface so the table can be used as a pool table or a checkerboard.

U.S. Pat. No. 4,474,374 to Lewis et al discloses a game table for playing Chinese billiards and which has an upstanding rail and pockets in the corners so the game can be played using wooden pucks.

SUMMARY OF THE INVENTION

The present invention is directed to a kit for converting a pool table to a surface that other games, such as"craps" can be played on. The kit contains a game playing surface that can be placed on top of the pool table surface and a vertical boundary layer that can be secured around the periphery of the game playing surface in order to cover the pockets in the pool table so that items will not fall into the pockets on the pool table.

It is an object of the present invention to provide a new and improved gaming table conversion kit for pool tables.

It is an object of the present invention to provide a new and improved gaming table conversion kit for pool tables that can be easily and quickly installed onto a pool table.

It is an object of the present invention to provide a new and improved gaming table conversion kit for pool tables that will cover the pockets in a pool table in order to prevent items from being"lost" in the pockets.

These and other objects and advantages of the present invention will be fully apparent from the following description, when taken in connection with the annexed drawings.

DESCRIPTION OF THE PREFERRED EMBODIMENT

Figure 1:
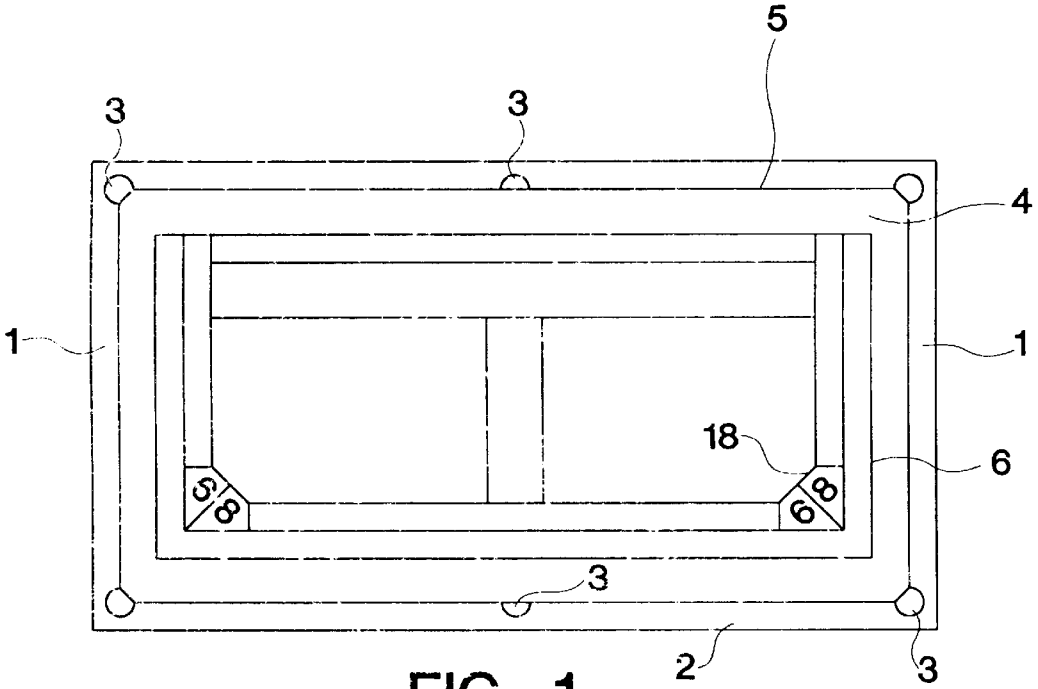
FIG. 1 is top view of the game playing surface of the present invention in place on top of the pool surface.
Figure 5:
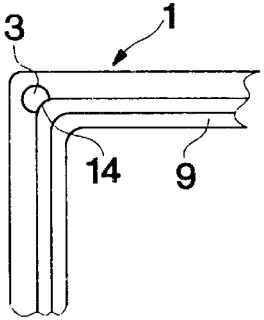
FIG. 5 is a top view of the boundary layer of the present invention as it blocks a pocket on the pool table.
Figure 4:
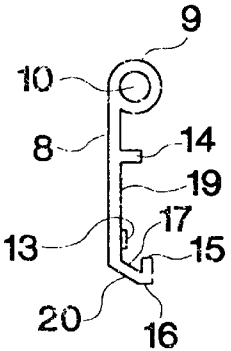
FIG. 4 is an end view of the boundary layer of the present invention.

Referring now to the drawings in greater detail, FIG. 1 shows the gaming surface 4 placed on top of a pool table.

The gaming surface 4 will have markings such as the markings 18 which will be relevant to the game being played. For example, the markings 18 are used in the game of "craps", however, any type of markings can be used on the gaming surface 4 so a different type of game can be played such as, but not limited to, Blackjack.

The conventional pool table has legs 8 (see FIG. 2) and ends 1 and sides 2, and there are pockets 3 positioned at the junction of the ends 1 and the sides 2 as well as in the middle of the sides 2. When the gaming surface 4 is placed on top of the pool table surface, the gaming surface 4 will not completely cover the pockets 3. This is because the pockets 3 extend through the horizontal surface of the pool table and, also, extend vertically through the ends 1 and the sides 2. Therefore, the pockets will extend above the gaming surface 4, and items, such as dice, if used on the gaming surface 4 could fall into the pockets 3. This will cause at least a minor interruption in the game, and may even cause a major interruption in the game if the gaming surface 4 has to be removed to retrieve the dice.

In order to prevent interruptions in the game, a boundary layer 7, see FIGS. 2–5, is placed around the periphery of the gaming surface 4 after it is placed on top of the pool table. The gaming surface 4 will block the vertical extent of the pockets 3 so that items used with the new game being played on the gaming surface 4 will not fall into the pockets 3 and be lost, or cause an interruption in the game.

The boundary layer 7 will be made from a material that is relatively stiff, but flexible such as, but not limited to, plastic or rubber. The material has to be flexible so it will be capable of being bent around the inner portion of the pool table sides 2 and ends 1. The material has to be relatively stiff so it will be capable of staying in place once it is positioned on the pool table.

Figure 2:
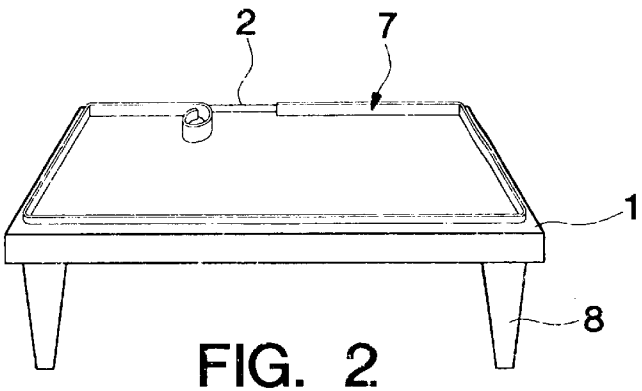
FIG. 2 is a perspective view of the boundary layer of the present invention being installed on the pool table.

The boundary layer 7, as shown in FIG. 2, will come in a roll that can be unwound as it is placed around the pool table, although it could come in other forms, other than rolls, without departing from the scope of the invention. The length of the boundary layer 7 could be made to fit a standard size pool table, and it can be cut to size for tables which are not standard size. After the boundary layer 7 is positioned around the inner surface of the ends 1 and the sides 2 of the pool table, the ends of the boundary layer 7 will have to be secured together in order to hold the layer in place.

Figure 3:
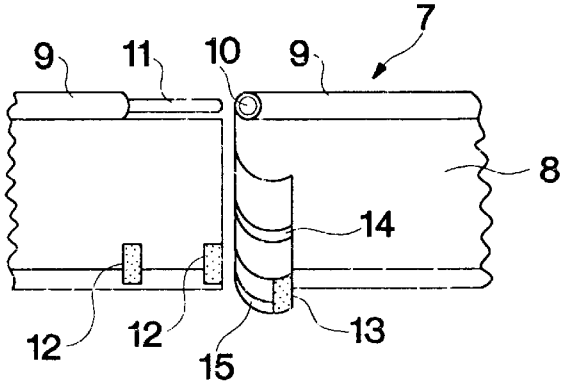
FIG. 3 is a partial perspective view of the joint which secures the ends of the boundary layer together.

FIG. 3 shows the joint used to secure the ends of the boundary layer 7. The boundary layer 7 has an outer or front surface 8 (the surface closest to the center of the pool table) and an inner or back surface 19 (the surface closest to the sides and the ends of the pool table). The top of the boundary layer 7 has has a hollow, circular tube 9 which is integrally attached by any conventional means such as, but not limited to, molding the tube 9 with the inner and outer surfaces 8, 19. The inside of the tube 9 has a hollow 10 which extends the length of the tube 9. On the back surface 19 a stand-off rib 14 is attached approximately midway between the bottom and top of the boundary layer 7. The rib 14 will engage the inner surfaces of the ends 1 and the sides 2 to position the boundary layer 7 so it covers the pockets 3 entirely.

Attached to the bottom of the boundary layer 7 is a hook-shaped portion 15, 16, 20 (see FIG. 4) which will receive the bottom of the opposite end of the boundary layer 7 when the ends are joined. In addition, fasteners 12, 13 is affixed to the inner and outer surfaces 8, 19 to help secure the meeting ends of the boundary layer 7. The fasteners 12, 13 shown in FIG. 3 are Velcro hook and loop type fasteners, however, other fasteners such as, but not limited to, nuts and bolts can also be used.

In order to secure the ends of the boundary layer 7, a joining peg 11 which has a smaller outer circumference than the inner circumference of tube 9. One end of the peg 11 is placed inside tube 9 on one end of the boundary layer 7 and the other end of the peg 11 is placed inside tube 9 on the other end of the boundary layer 7. Then the bottom of one end of the boundary layer 7 is slid into the groove 17 formed inside the hookshaped portion 15, 16, 20 on the other end of the boundary layer 7. Finally, the fasteners 12, 13 are secured to firmly hold the ends of the boundary layer 7 together.

Also, it should be noted that the conversion kit has been describe as being used with a pool table, however, this is not the only utility for the kit of the present invention. For example, a pool table is not essential in order to use the invention. The playing surface 4 could be placed on any surface, such as a floor, and the boundary layer could be placed around the boundary layer 7 and its ends secured together, as described above.

Although the Gaming Table Conversion for Pool Tables and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A kit for converting a pool table to a gaming table, said pool table having a top surface, sides and ends, and pockets positioned at selective locations, around said sides and ends, said kit comprising:

a playing surface adapted to be placed on said top surface of said pool table, said playing surface adapted to extend between said sides and said ends of said pool table, a boundary layer adapted to be positioned around a periphery of said playing surface, said boundary layer comprising:

a front surface, a back surface, a top, a bottom, and opposite ends, a hollow portion attached to said top, said hollow portion having an inner and outer dimension, means adjacent said top of said boundary layer for joining, opposite ends of said top of said boundary layer together, means adjacent said bottom of said boundary layer for securing said opposite ends of said boundary layer together.

2. The kit for converting a pool table to a gaming table as claimed in claim 1, wherein said means adjacent said bottom of said boundary layer for securing said opposite ends of said boundary layer together comprises:

hook and loop type fasteners.

3. The kit for converting a pool table to a gaming table as claimed in claim 1, wherein said means adjacent said bottom of said boundary layer for securing said opposite ends of said boundary layer together comprises:

a hook shaped portion formed on one end of said bottom of said boundary layer, said hook shaped portion receiving another end of said boundary layer when said opposite ends of said boundary layer are joined together.

4. The kit for converting a pool table to a gaming table as claimed in claim 1, wherein said means adjacent said bottom of said boundary layer for securing said opposite ends of said boundary layer together comprises:

hook and loop type fasteners, and a hook shaped portion formed on one end of said bottom of said boundary layer, said hook shaped portion receiving another end of said boundary layer when said opposite ends of said boundary layer are joined together.

5. The kit for converting a pool table to a gaming table as claimed in claim 1, wherein said boundary layer has a projecting portion formed on said back surface positioned approximately midway between said top and bottom of said boundary layer.

6. The kit for converting a pool table to a gaming table as claimed in claim 1, wherein said means adjacent said top of said boundary layer for joining opposite ends of said top of said boundary layer together is a peg, said peg having an outer dimension which is smaller than said inner dimension of said hollow portion, an end of said peg being secured to one end of said hollow portion, when said opposite ends of said boundary layer are joined together, said peg is received within one end of said hollow portion of said boundary layer and another end of said peg is received within another end of said hollow portion of said boundary layer.

* * * * *